US006471019B1

(12) United States Patent
Miller

(10) Patent No.: US 6,471,019 B1
(45) Date of Patent: Oct. 29, 2002

(54) TRAVEL CASE WITH DEPLOYABLE TABLE

(75) Inventor: Jacqueline N. Miller, Boca Raton, FL (US)

(73) Assignee: Travelpro International, Inc., Boca Raton, FL (US)

( * ) Notice: Subject to any disclaimer, the term of this patent is extended or adjusted under 35 U.S.C. 154(b) by 0 days.

(21) Appl. No.: 09/532,695

(22) Filed: Mar. 22, 2000

(51) Int. Cl.[7] ..... A45F 3/00

(52) U.S. Cl. ..... 190/11; 190/10; 190/115; 190/111

(58) Field of Search ..... 190/1–12 A, 107, 190/111, 900, 115; 206/320, 305, 576; 108/42, 48, 150; 312/231; 248/447, 452

(56) References Cited

U.S. PATENT DOCUMENTS 988,937 A * 4/1911 Holland ..... 190/11
3,557,916 A * 1/1971 Stowell ..... 190/11
3,669,227 A * 6/1972 Alford ..... 190/11
4,412,604 A 11/1983 Bell et al.
4,856,627 A * 8/1989 Polatov ..... 190/11
4,966,258 A 10/1990 Hawley
5,242,056 A 9/1993 Zia et al.
5,411,192 A * 5/1995 Xiao ..... 190/11 X
5,437,367 A * 8/1995 Martin ..... 190/11
5,529,322 A * 6/1996 Barton ..... 280/30
5,941,352 A * 8/1999 Lee ..... 190/11
5,957,349 A * 9/1999 Krulik ..... 224/155
6,105,508 A * 8/2000 ryburg ..... 108/42

* cited by examiner

*Primary Examiner*—Lee Young
*Assistant Examiner*—Tri M. Mai
(74) *Attorney, Agent, or Firm*—Akerman Senterfitt

(57) ABSTRACT

Disclosed herein is a travel case having a deployable and retractable tray table assembly mounted to the back of the housing. The tray table is hinged to an extension member slidably disposed in a pocket within the compartment. The tray table is stowed within and completely contained by the compartment when not deployed. By unzipping the compartment and sliding the tray table and extension member upwardly, the tray table can be pivoted upwardly to a support position. In the support position, the tray table can rest upon the top of the case and the extension member can be locked in place so that it cannot slide downward. The compartment can be closed up around the extension member when the tray table is deployed.

19 Claims, 4 Drawing Sheets

TRAVEL CASE WITH DEPLOYABLE TABLE

CROSS-REFERENCE TO RELATED APPLICATIONS (Not applicable.)

STATEMENT REGARDING FEDERALLY SPONSORED RESEARCH AND DEVELOPMENT (Not applicable.)

BACKGROUND OF THE INVENTION

The present invention relates to luggage and, more particularly, to a travel case having a deployable table top for supporting objects such as a portable computer.

Luggage having compartments to store common travel items such as clothes, toiletries and other accessories are well known in the art. Similarly, cases for carrying portable computers are also well known in the art, see for example U.S. Pat. No. 5,242,056 issued to Zia et al.

Typically, airplane travelers carry portable computers in a separate case in addition to a conventional suitcase in which common travel items are stored. This is done so that the often larger suitcase can be checked with the airline and the computer can be brought onboard the airplane and used during the flight to catch up on work while away from the office. Additionally, airplane travelers also utilize their portable computers while waiting at airport terminals. Often, however, there is no suitably flat surface upon which to place a computer.

Efforts to combine conventional suitcases with computer storage and supporting cases have resulted in cases that are bulky and difficult to use. For example, U.S. Pat. No. 5,437,367 issued to Martin discloses a carrying case for electronic components including numerous foldable support platforms. This case has a large, hard housing such that it cannot be brought onboard an airplane. Instead, it must be stowed in the airplane's cargo hold such that a traveler carrying this case must forgo using the portable computer during the flight or carry an additional, smaller case, which can be awkward. Moreover, the case must be opened and the contents removed to access the collapsed supporting structures stored inside. This makes the supporting structures impractical to use at an airport terminal or at other such location. Further, the supporting structures occupy storage space which reduces the amount of travel items that can be carried within the case.

Accordingly, there is a need in the art for a compact case capable of holding travel items as well as providing a support table for a portable computer.

SUMMARY OF THE INVENTION

The travel case of the present invention provides a carrying case with a deployable tray table compactly disposed within and neatly concealed by a compartment at the back of the case. The tray table can be pivoted to rest on top of the case, thereby providing a horizontal surface to support a portable computer.

In particular, the present invention provides a travel case for storing clothing, accessories and the like including a housing defining a storage space and having a top and a back side. At the back side of the housing is a reclosable tray table compartment in which is disposed an extension member which is mounted to the housing so that it can slide in a plane parallel with the back side of the housing. The extension member has a free top end to which is a tray table is rotatably attached. When the extension member is in an extended position, the tray table can be rotated to a support position providing a generally horizontal surface suitable for supporting electronic devices, such as a portable laptop computer. When the extension member is in a retracted position, the tray table can rotate to a stored position within the compartment.

It is therefore a principle object of this invention to provide a travel case which includes a deployable tray table mounted to the housing. The tray table can be deployed to form a substantially horizontal planar surface for supporting a portable computer. The tray table can retracted to be compactly stored in a zippered compartment at the back side of the housing.

It is an additional object of this invention to combine the features of conventional luggage with the features of a portable computer support table. This is accomplished by the housing defining storage space for containing clothing, accessories and the like.

In one aspect of the invention, the extension member is locked in place when the tray table is in the support position. A latch slidably attached to the extension member and operated by the tray table when in the support position to engage the bracket. In another aspect, tray table is above the housing top when deployed to the support position. In this way, feet at the bottom of the tray table can rest upon the housing top.

It is still yet another object of this invention to provide a stable and secure support for a portable computer. This accomplished by locking the extending member in the extended position and resting the tray top on the top of the housing when in the support position. Moreover, non-skid surfaces on the top of the tray table prevent a portable computer from sliding.

In other preferred forms of the present invention, the travel case has a computer compartment for storing a portable computer at a front side. Also, the travel case includes a wheel assembly and a retractable handle for pulling the travel case.

In accordance with these and other objects which will become apparent hereinafter, the present invention will now be described with particular reference to the accompanying drawings.

DETAILED DESCRIPTION OF THE PREFERRED EMBODIMENT

Figure 1:
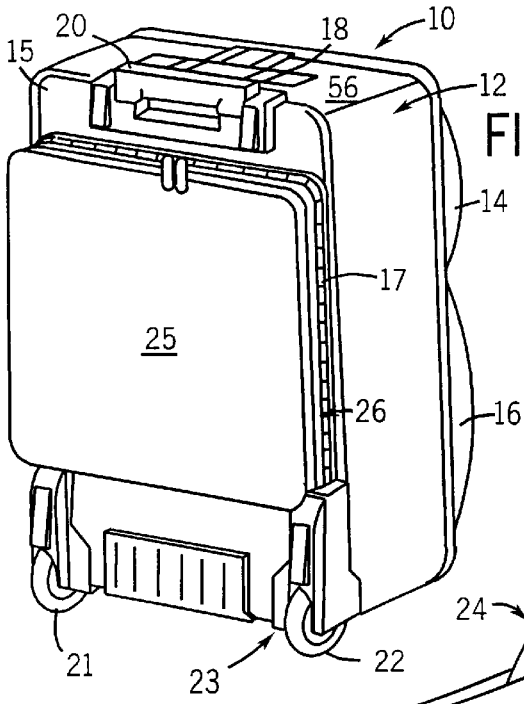
FIG. 1 is a rear perspective view of luggage of the present invention.

A travel case of the present invention is referred to generally in the drawings by reference numeral 10. Referring to FIG. 1, the travel case 10 has a housing 12 enclosing a storage volume for holding clothes, accessories and the like. The housing 12 preferably includes expandible front compartments including a computer compartment 14 and an accessory compartment 16. The housing 12 can include a fixed handle 18 and a retractable handle assembly 20 for pulling the travel case 10 as it rides on wheels 21 and 22 of a wheel assembly 23 suitably mounted at a bottom rear corner of the housing 12. Also at the back side 15 is a tray table compartment 24 having a side flap 25 that can be opened (see arrow 27 in FIG. 2) and closed by a zipper 17.

Figure 2:
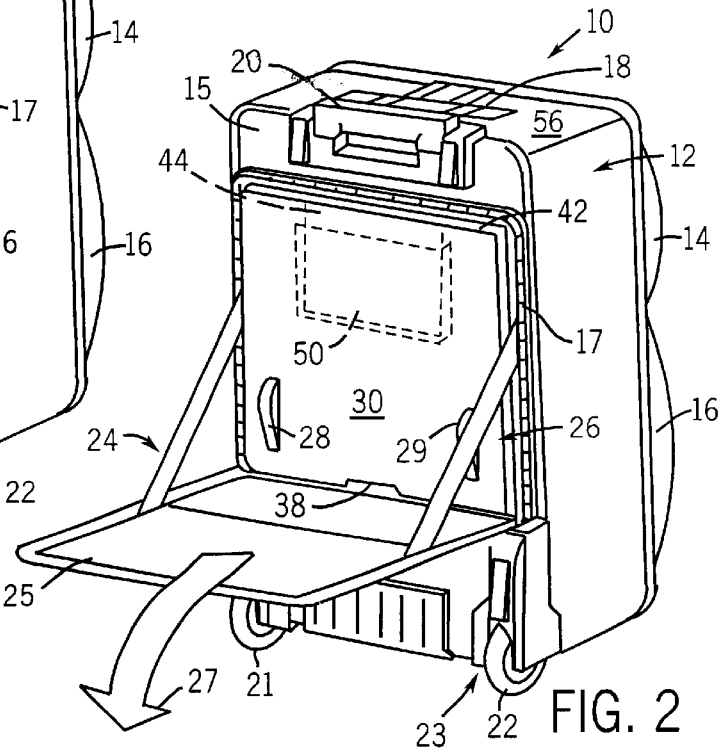
FIG. 2 is a rear perspective view of the luggage with a tray table compartment opened and a tray table retracted.
Figure 4:
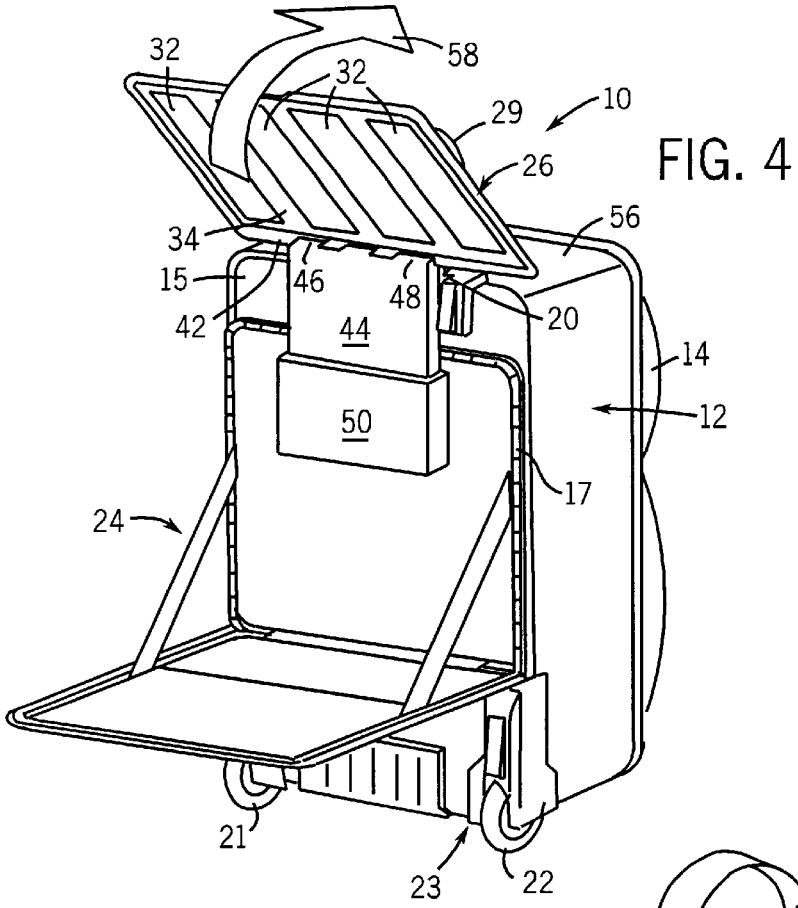
FIG. 4 is a rear perspective view of the luggage showing the tray table being rotated upward.

Referring to FIG. 2, the tray table compartment 24 houses a deployable tray table 26. The tray table 26 is generally a rectangular, planar member of a suitable rigid plastic having stabilizing feet 28 and 29 at a bottom side 30. The tray table 26 can be completely contained within the tray table compartment 24. In this way, it does not occupy storage space within the housing reserved for other travel items. The tray table 26 is sufficient large and robust to support conventional laptop portable computers as well as other suitable items, such as food, drinks, books, files and papers. Referring momentarily to FIG. 4, the tray table 26 also preferably has non-skid surfaces 32 made of a suitable material such as polyvinylchloride at a top side 34. The non-skid surfaces 32 help prevent objects from sliding off the tray table 26. The tray table 26 also preferably includes a recess 38 at a bottom edge 40 providing a hand grip location.

Figure 3:
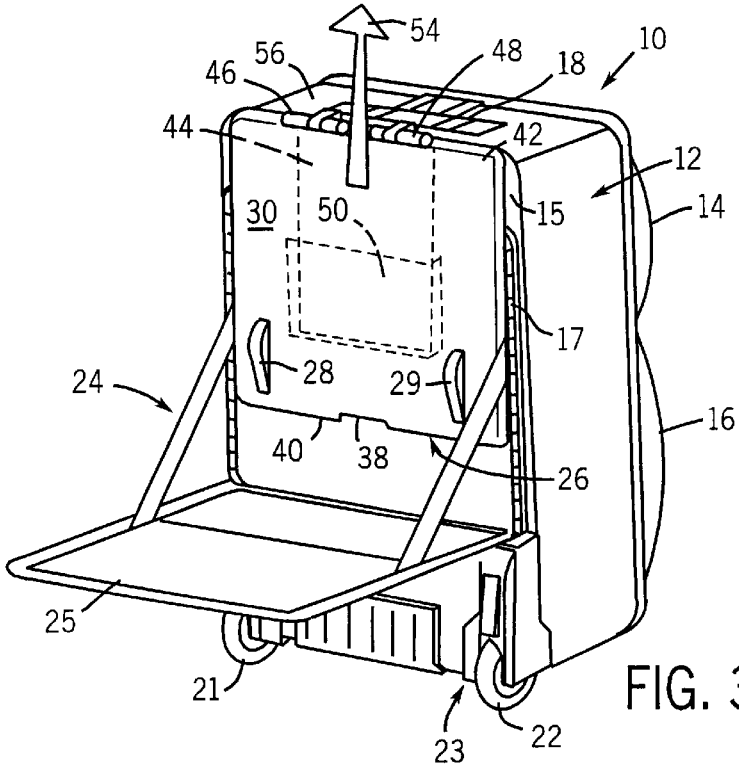
FIG. 3 is a rear perspective view of the luggage with the tray table extended upward.

Referring to FIGS. 3 and 4, the tray table 26 is rotatably mounted at a top edge 42 to an extension member 44 by two hinge connections 46 and 48. The extension member 44 slides longitudinally up and down in a plane parallel to the back side 15 of the housing 12 within a recess 49 (see FIG. 7) of a mounting bracket 50 suitably fixed to an inner wall within the tray table compartment 24. The mounting bracket 50 is secured in place at openings 43 (see FIG. 6) by suitable fasteners and bracketry (not shown) within the housing 12.

Figure 5:
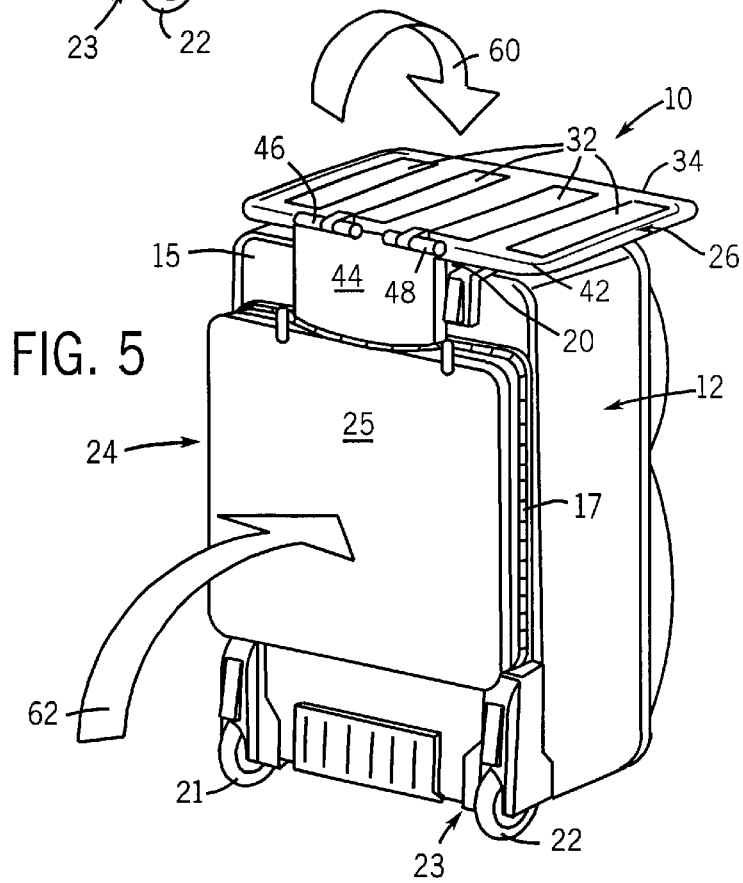
FIG. 5 is a rear perspective view of the luggage with the tray table resting upon the top of the luggage in position for supporting items such as a portable computer and with the tray table compartment closed.

As shown by arrow 54 in FIG. 3, the tray table 26 and extension member 44 can be pulled upward to an extended position in which the hinged connections 46 and 48 are above a top 56 of the housing 12. As shown by arrow 58 in FIG. 4 and arrow 60 in FIG. 5, the tray table 26 can then be rotated upwardly at the hinged connections 46 and 48 to a support position in which the top side 34 is essentially horizontal and the feet 28 and 29 rest on the housing top 56. The tray table compartment 24 can be closed up around the extension member 44 by the zipper 17, as shown by arrow 62 in FIG. 5. By reversing the process shown by the arrows of FIGS. 2–5, the tray table 26 can be collapsed and neatly stowed away within the closed tray table compartment 24.

Figure 6:
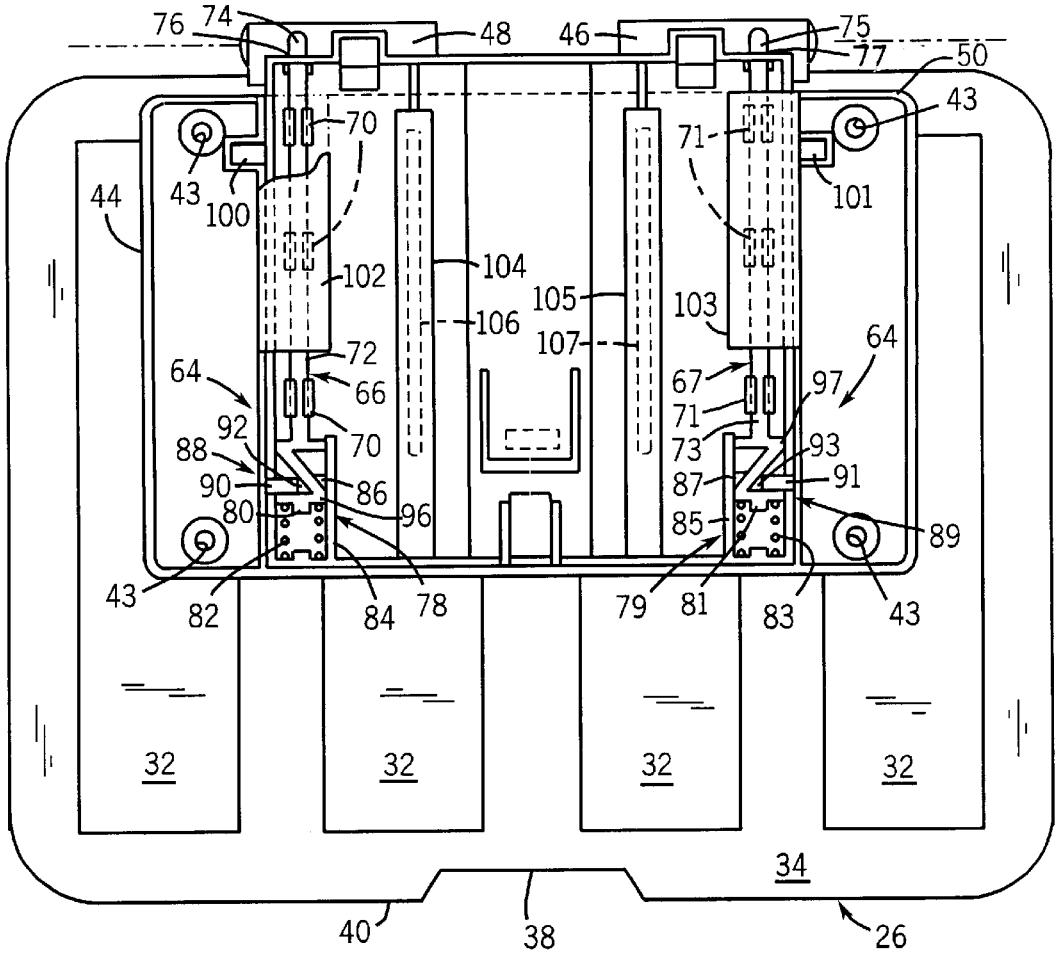
FIG. 6 is a front plan view of the slide mechanism for extending the tray table with the tray table retracted.
Figure 7:
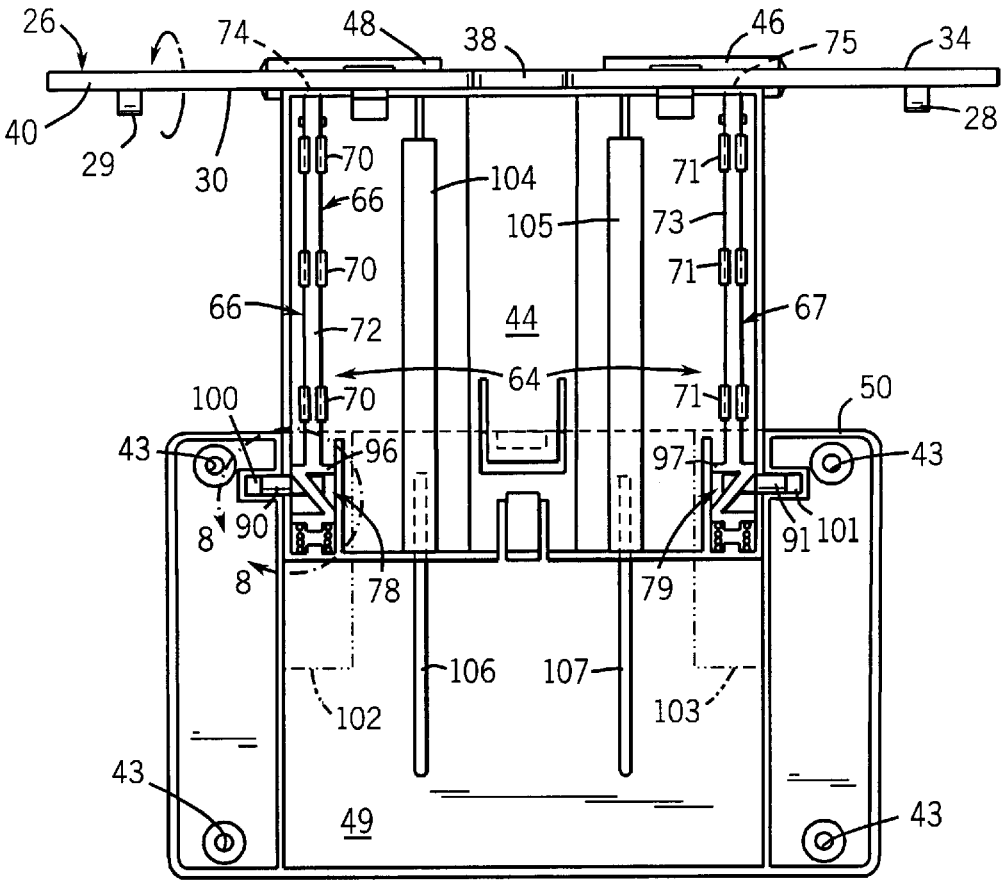
FIG. 7 is a front plan view similar to FIG. 6 with the tray table fully extended.

FIGS. 6 and 7 illustrate a latching mechanism 64 slidably attached at a back side of the extension member 44 when the extension member 44 is in the retracted and extended positions, respectively. The latching mechanism 64 is operated by the tray table 26 to lock the extension member 44 in a fixed position when the tray table 26 is in the support position. The latch mechanism 64 includes latch pins 66 and 67 slidably fastened to the extension member 44 by clips 70. The latch pin 66 includes an elongated body 72 having a free end 74 slidable within openings 76 of the extension member 44. An opposite confined end 78 has a reverse Z-shaped member 96 with a post 80 to which is fit a compression spring 82. The confined end 78 is retained by a wall 84 which also confines wedge 86 as well as catch 88. Catch 88 has a rounded end 90 and a wedged end 92 which cooperates with the wedge 86 and the reverse Z-shaped member 96 to translate laterally as the latch pin 66 is moved. Latch pin 67 is identical to latch pin 66 and has elements corresponding to those stated above with respect to latch pin 66, referred to in FIGS. 6 and 7 by corresponding odd numerals. The latch pin 67 is oriented, however, as a longitudinal mirror image of latch pin 66 so that the confined end 79 has a Z-shaped member 97.

Figure 8:
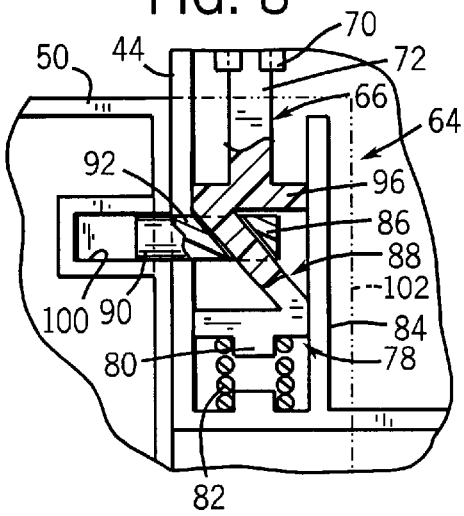
FIG. 8 is a cross-sectional view taken along line 8—8 of FIG. 7.

Thus, as shown in FIG. 6 when the tray table 26 is in the stowed position, and the extension member 44 is retracted, the free ends 74 and 75 of the latch pins 66 and 67 extend past the openings 76 and 77 in the extension member 44. However, when the tray table 26 is fully deployed to the support position, the extension member 44 is in the extended position and the bottom side of the tray table 26 contacts the free ends 74 and 75 of the latch pins 66 and 67. This forces the latch pins 66 and 67 downward and compresses the springs 82 and 83. Referring to FIG. 8, the movement of the latch pins 66 and 67 causes the Z-shape to cooperate with the wedges 86 and 87 and wedge ends 92 and 93 of the catches 88 and 89 so as to push the round end 90 and 91 of the catches 88 and 89 into slots 100 and 101 in the bracket 50. This locks the extension member 44 in the fully extended position. By lifting and rotating the tray table 26 back again, the tray table 26 no longer contacts the free ends 74 and 75 of the latch pins 66 and 67 and the compressed springs 82 and 83 return the latch pins 66 and 67 to their initial position. Retainers 102 and 103 cover the Z-shape ends 78 and 79 when the extension member 44 is extended. As shown in FIG. 7, the extension member 44 has longitudinal grooves 104 and 105 (shown in phantom) allowing it to ride along rails 106 and 107 at the inside of the bracket 50 as it is extended and retracted.

The present invention has been shown and described herein in what is considered to be the most practical and preferred embodiment. It is recognized, however, that departures may be made therefrom within the scope of the invention and that obvious modifications will occur to a person skilled in the art.

What is claimed is:

1. A travel case for storing clothing and accessories, comprising:

a housing defining a storage space and having a top and a back side;

a reclosable tray table compartment at the housing back side;

an extension member slidably secured to the housing and having a free top end, the extension member slidable in a plane parallel with the back side; and a substantially rigid tray table rotatably mounted at the top end of the extension member;

wherein when the extension member is in an extended position, the tray table can be rotated to a support position providing a generally horizontal surface and wherein when the extension member is in a retracted position, the tray table can be rotated to a stored position within the compartment.

2. The luggage of claim 1, wherein the support position is above the housing top.

3. The case of claim 2, wherein the tray table includes feet at a bottom side.

4. The case of claim 3, wherein the feet rest upon the housing top when the tray table is in the support position.

5. The case of claim 1, wherein the extension member is locked in place when the tray table is in the support position.

6. The case of claim 5, wherein the extension member is slidable within a bracket disposed within the tray table compartment so as to be movable from the retracted to the extended positions.

7. The case of claim 6, further comprising a latch slidably attached to the extension member and operated by the tray table when in the support position to engage the bracket.

8. The case of claim 1, wherein the tray table is connected to the extension member by one or more hinges.

9. The case of claim 1, further comprising a wheel assembly having a plurality of wheels wherein the wheels are rotatably affixed to the main housing.

10. The case of claim 1, wherein the main housing includes a retractable handle affixed to the main housing.

11. The case of claim 10, wherein the housing further includes a front side having a computer compartment for storing a portable computer.

12. The case of claim 1, further comprising a zipper for closing the tray table compartment.

13. The case of claim 1, wherein the tray table includes non-skid surfaces at a top side.

14. Combination luggage comprising a travel case and a support assembly, wherein the travel case has a housing with a top and a back side, the back side having a reclosable tray table compartment and wherein the support assembly includes:

a mount fixedly attached to the housing within the tray table compartment and defining a central recess;

an extension member slidably disposed within the recess of the mount; and a substantially rigid tray table rotatably attached to an end of the extension member by at least one hinge;

wherein when the extension member is in an extended position, the tray table can be rotated to a support position above and essentially parallel with the housing top to provide a generally horizontal surface suitable for writing and supporting electronic devices, and wherein when the extension member is in a retracted position, the tray table can rotate to a stored position within the compartment.

15. The luggage of claim 14, wherein the support assembly also includes a latch slidably attached to the extension member and operated by the tray table when in the support position to engage the mount so that the extension member cannot slide.

16. A travel case, comprising:

a luggage housing having a top panel, a bottom panel, a front panel and a back panel, said front and back panels spaced apart and extending from said bottom panel to said top panel; and a tray table slidably mounted on an external side of said back panel, said tray table being selectively slidably movable from a stowed position adjacent and generally parallel to said back panel, to a raised support position;

said tray table rotatable by approximately 270° so that it rests on said top panel when said tray is in the support position.

17. The case of claim 16, wherein said tray table has feet at a bottom side thereof, said feet resting on said top panel when said tray table is in the support position.

18. The case of claim 16, wherein said tray table is stored in a tray table compartment mounted on an external side of said back panel.

19. The case of claim 16, wherein the housing further includes a computer compartment for storing a personal computer.

* * * * *